US007096544B2

(12) United States Patent
Lusardi

(10) Patent No.: US 7,096,544 B2
(45) Date of Patent: Aug. 29, 2006

(54) WRAP-IT

(76) Inventor: Kevin Timothy Lusardi, 355 Green Rd., Sparta, NJ (US) 07871

( * ) Notice: Subject to any disclaimer, the term of this patent is extended or adjusted under 35 U.S.C. 154(b) by 0 days.

(21) Appl. No.: 10/411,718

(22) Filed: Apr. 12, 2003

(65) Prior Publication Data

US 2004/0200044 A1 Oct. 14, 2004

(51) Int. Cl.
*A44B 18/00* (2006.01)

(52) U.S. Cl. ..... 24/306; 281/19.2; 402/8; 402/80 R

(58) Field of Classification Search ..... 24/30.5 R, 24/298, 300–302, 306, 442, 16 R; 40/312, 40/329, 586, 662; 249/149, 150, 152, 165; 281/19.1, 19.2, 16, 43, 51; 402/8, 9, 12, 402/13, 80 R See application file for complete search history.

(56) References Cited

U.S. PATENT DOCUMENTS 4,230,753 A * 10/1980 Sheyon ..... 428/40.6
4,273,130 A * 6/1981 Simpson ..... 606/203
4,661,105 A * 4/1987 Gale ..... 424/448
4,728,571 A * 3/1988 Clemens et al. ..... 428/352
4,862,563 A * 9/1989 Flynn ..... 24/442
4,998,185 A * 3/1991 DeNigris, Jr. ..... 248/444
5,142,743 A * 9/1992 Hahn ..... 24/442
5,168,603 A * 12/1992 Reed ..... 24/306
5,215,379 A * 6/1993 Pickard et al. ..... 383/37
5,233,380 A * 8/1993 Marvy ..... 396/526
5,289,619 A * 3/1994 Pileggi ..... 24/306
5,400,936 A * 3/1995 Jones et al. ..... 224/222
5,405,010 A * 4/1995 Goldberger ..... 206/5
5,452,479 A * 9/1995 Mostert ..... 40/329
5,456,497 A * 10/1995 Ross, Jr. ..... 281/42
5,520,462 A * 5/1996 Clark ..... 383/37
5,636,503 A * 6/1997 Kaspszyk ..... 24/17 A
5,636,868 A * 6/1997 Ross, Jr. ..... 402/4
5,779,655 A * 7/1998 Holden ..... 602/5
6,045,159 A * 4/2000 Bellah ..... 281/29
6,146,348 A * 11/2000 Slautterback ..... 602/5
6,164,213 A * 12/2000 Topps et al. ..... 108/43
6,170,959 B1 * 1/2001 Richardson, III ..... 362/103
6,189,968 B1 * 2/2001 Emanuel et al. ..... 297/188.01
6,205,623 B1 * 3/2001 Shepard et al. ..... 24/306
6,446,803 B1 * 9/2002 McKinney ..... 206/371
6,655,868 B1 * 12/2003 Drew ..... 402/8
6,662,733 B1 * 12/2003 Scott ..... 108/43
6,728,996 B1 * 5/2004 Roscow ..... 24/306
6,749,095 B1 * 6/2004 Johnson ..... 224/250
6,763,554 B1 * 7/2004 Torrey et al. ..... 24/30.5 P
6,835,182 B1 * 12/2004 Darcey ..... 602/20
2002/0010410 A1 * 1/2002 Steponovich ..... 602/26
2002/0139823 A1 * 10/2002 Johnson ..... 224/250
2003/0178461 A1 * 9/2003 Shattuck
2004/0006854 A1 * 1/2004 Simon ..... 24/306

FOREIGN PATENT DOCUMENTS

GB 2 155 326 A * 9/1985

* cited by examiner

*Primary Examiner*—Robert J. Sandy
*Assistant Examiner*—Ruth C. Rodriquez

(57) ABSTRACT

An organizational device devised for the wrapping of articles. The device includes an elongate continuous elastic loop fabric strap. A hook fastener is imported at one end of the strap. The hook fastener is attachable to the strap at any location therealong. Once attached the strap forms a wrap about the articles. The strap may also include useful information, logos and the like thereon.

9 Claims, 6 Drawing Sheets

WRAP-IT

FIELD OF INVENTION

The essence of WRAP-IT! is its utility as an organizer tool that is more flexible and secure than existing organizer tools. The benefits of WRAP-IT! can be enjoyed by the business community, students/teachers & the educational community as well as for home and personal use. WRAP-IT! fulfills a need to be more organized by preventing files from turning into piles and keeping other objects in a secure fashion while maintaining easy access.

BACKGROUND OF INVENTION

WRAP-IT! addresses a currently unsatisfied need in the area of flexible organizational tools. Related endeavors for which US Patent Classifications exist as determined from a search of the US Patent Office database for hook and loop fastener, CCL/224/620 include 19 patents. Review of the claims, use, and design specifications of these inventions indicate that WRAP IT! offers features and use that distinguish its applications from any of the other 19 products. Many of these products address the use of straps to secure gloves, cameras, carrying bags, and musical instruments. Most of these uses employ the strap concept as a harness to be wrapped around the torso or shoulders of the user. None of the products reviewed addressed the need for securing files, paperwork and other articles to offer a user-friendly organizational tool. WRAP-IT! offers users to have easy access to files and documents contained in the wrap while providing a secure environment for important information. Additions and removal of select sheets can be easily performed. Loose-leaf binders provide a similar environment. However, holes are required to be made in all entered documents, which may not be desirable and does not allow for easy last minute additions and deletions. WRAP-IT! used in concert with brief cases or file folders, provides a flexible means of keeping organized documents intact especially when transferring these documents to/from your home, office, school, or to clients' premises.

BRIEF SUMMARY OF THE INVENTION

To be organized is an essential element for success. Tools developed to meet this fundamental objective include loose-leaf notebooks, sticky post-its, file-folders, briefcases, and even rubber bands. Each tool enhances ones organizational efficiency by providing a secure way to maintain files and documents, labeling files, separating documents, and transferring files and documents in a secure manner. WRAP-IT! meets all these needs and was designed to be used in place of or in concert with these other devices. WRAP-IT! is more flexible than a loose-leaf notebook as unwanted holes are not required and last minute additions and deletions are much easier. WRAP-IT! adjusts to any size and is both more reliable and professional than using rubber bands. WRAP-IT! used in concert with brief cases or file folders, provides a flexible means of keeping documents intact especially when transferring these documents to/from home, office, school, or clients' premises. In addition, WRAP-IT! provides marketing benefits that other devices do not offer.

This product has a broad array of organizational applications that will fulfill a need that is not currently being met. The following list of applications for WRAP-IT! reflects the strong utility factor for this product:

"On the road" sales representatives use for keeping client files and sales brochures intact while traveling in the car.

With corporate logo on both loop fabric and vinyl backing, used to wrap around bids submissions, sales proposals, sales literature and presentation handouts. "Leave behind" concept.

Internal office corporate use to organize departmental files.

Attorneys and CPAs use for client files. Used both in office and in-transit.

College, high school, and Jr. high students use to organize daily homework submissions and school projects.

Teachers use to keep student files intact and organized especially when transferring files to/from home and school.

Home office use for organizing both family and business paperwork and files.

Private fitness centers and college athletic department use to keep towel wrap contents (socks, shirt, shorts) intact.

This product, with the use of logos for corporate, team, college, school, firm or any other organization, provides a powerful branding and marketing tool along with the primary function as an organizational tool of preventing files from turning into piles.

BRIEF DESCRIPTION OF THE DRAWINGS

Drawing 1

Figure 2:
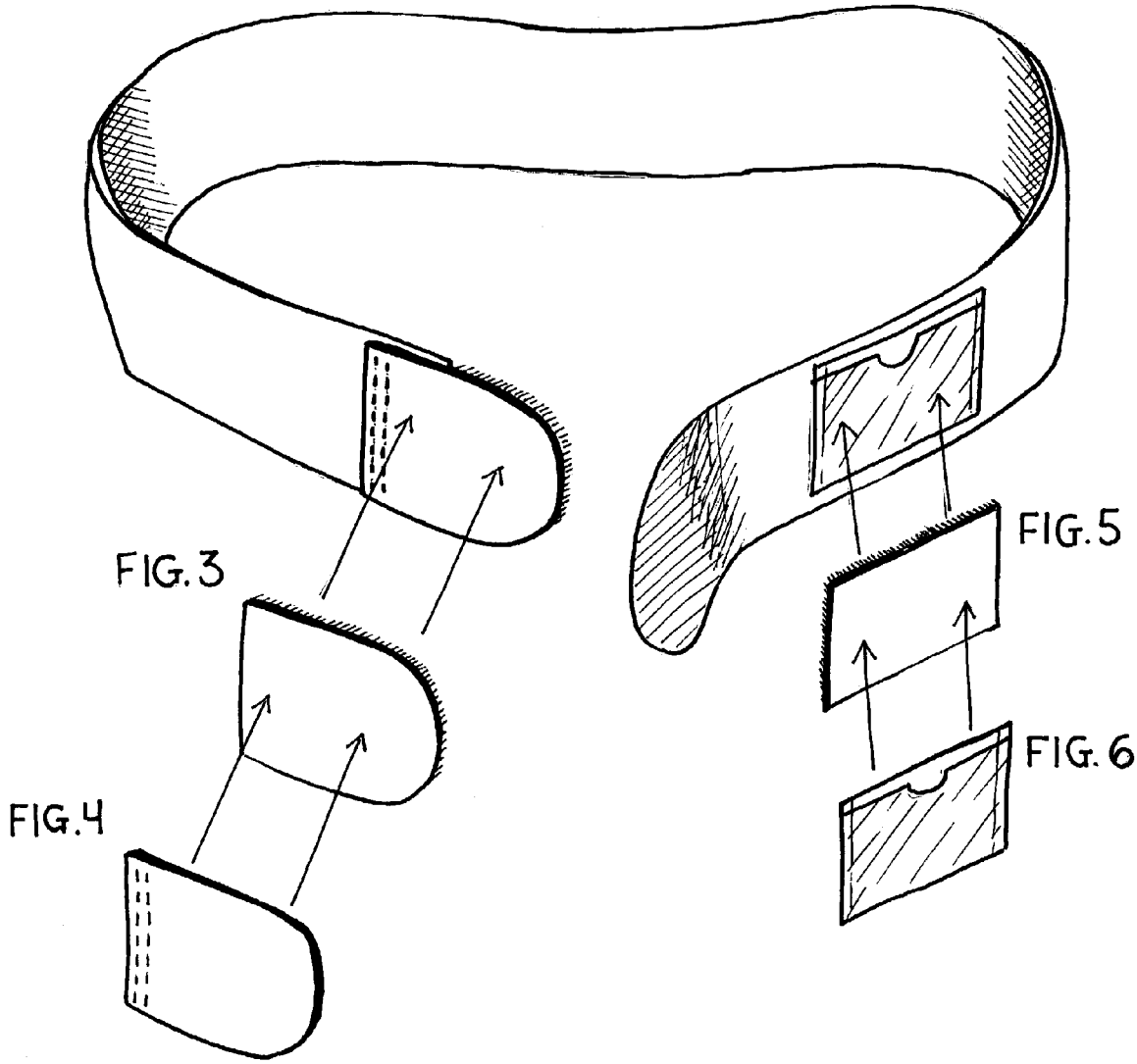

Drawing 2 Shows view of exploded components and how they are to be configured:

FIG. 2: Expandable loop fabric strap; (wrap)

FIG. 3: Hook fabric; (wrap fastener)

FIG. 4: Vinyl fabric or leather; (fastener cover)

FIG. 5: Vinyl sleeve with clear plastic cover; (sleeve)

FIG. 6 Hook fabric; (sleeve fastener)

Drawing 3

Figure 7:
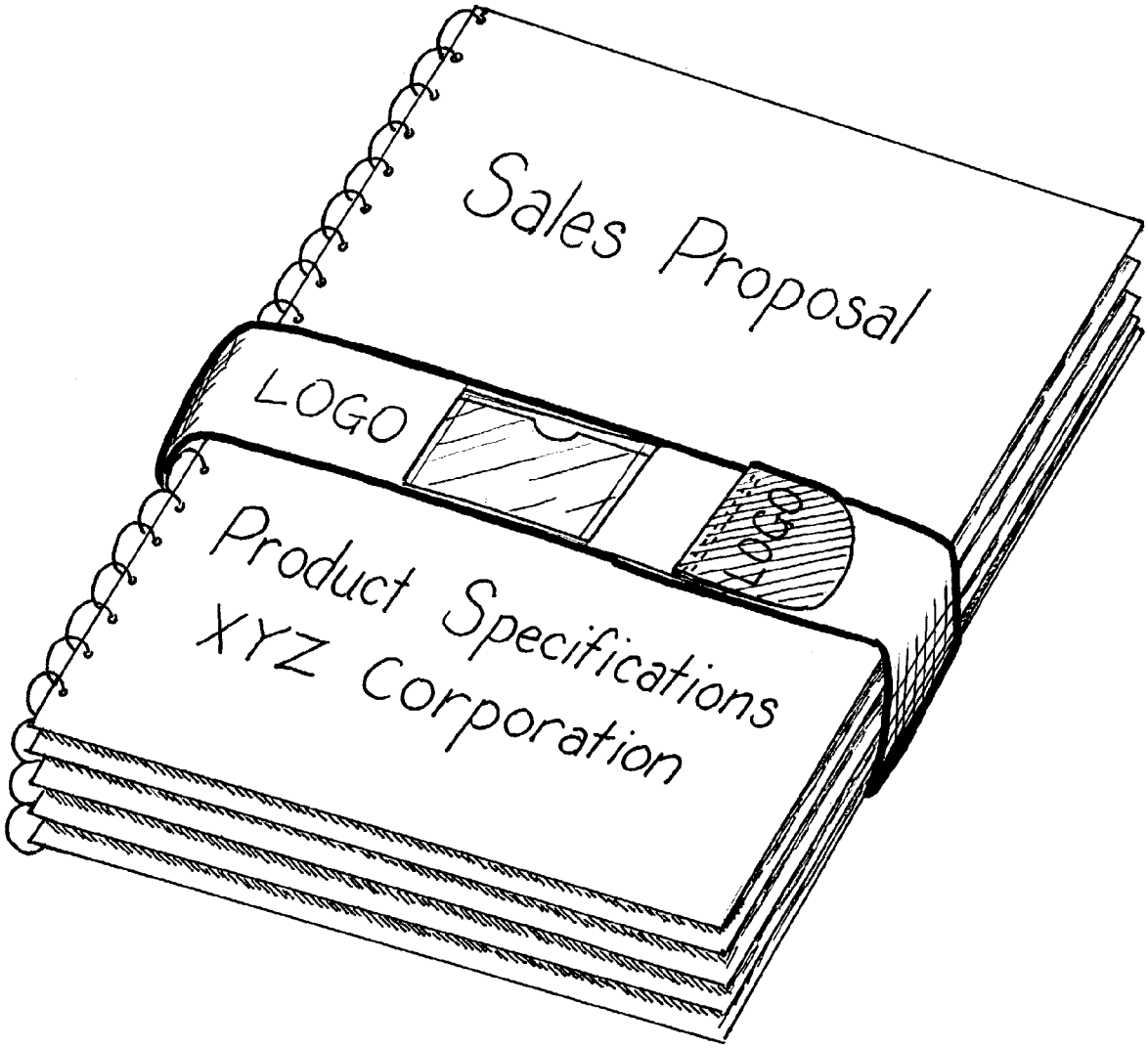

FIG. 7 Shows business application/utility of WRAP-IT! where the product is used to secure a business proposal presentation. Company logo capability is also demonstrated on both wrap and fastener cover. "Leave Behind" concept is demonstrated as WRAP-IT! will be left with the prospective client as part of the proposal package.

Drawing 4

Figure 8:
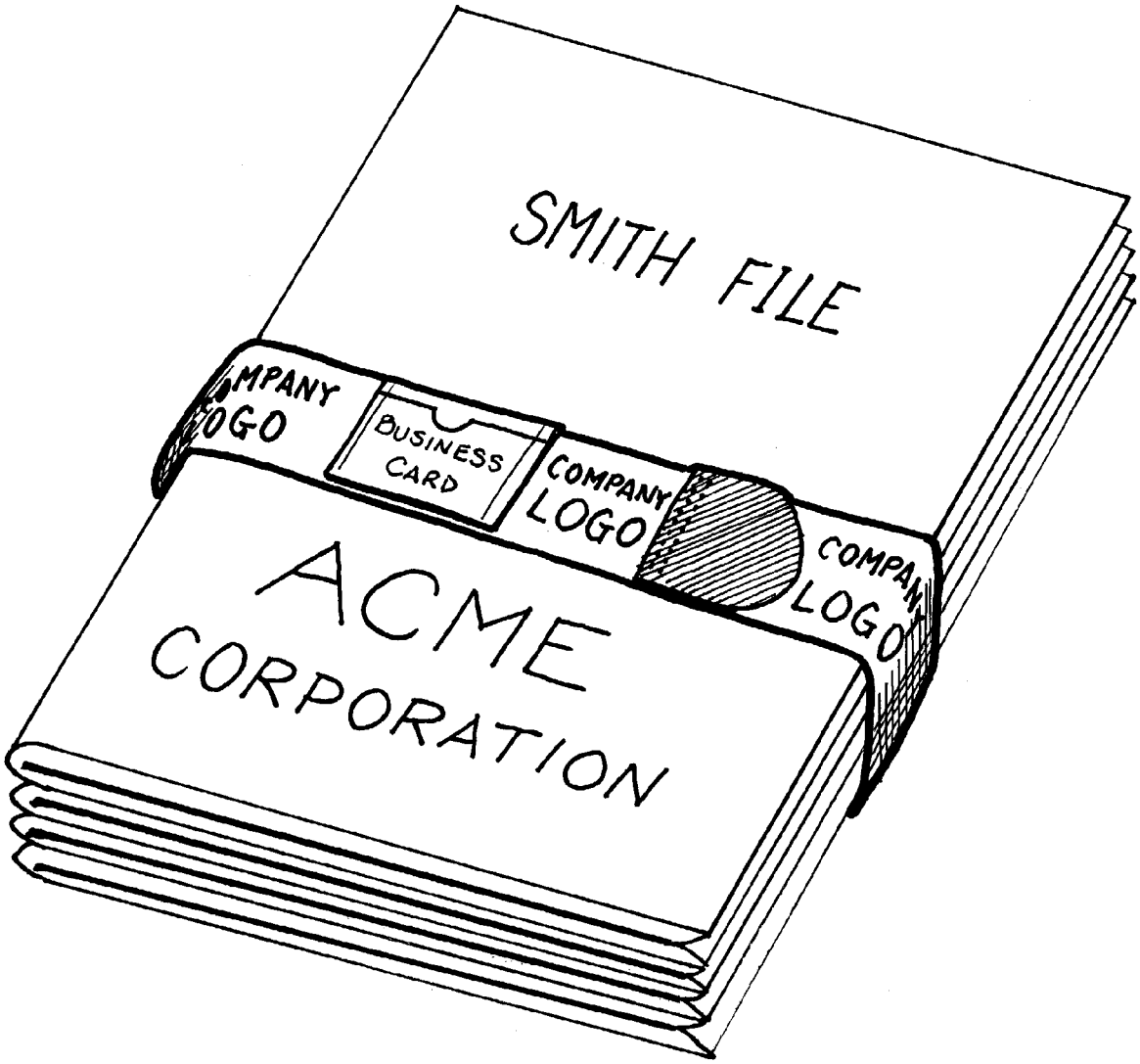

FIG. 8 Shows business application/utility of WRAP-IT! where the product is used to secure client files. Company logo capability is also demonstrated.

Drawing 5

Figure 9:
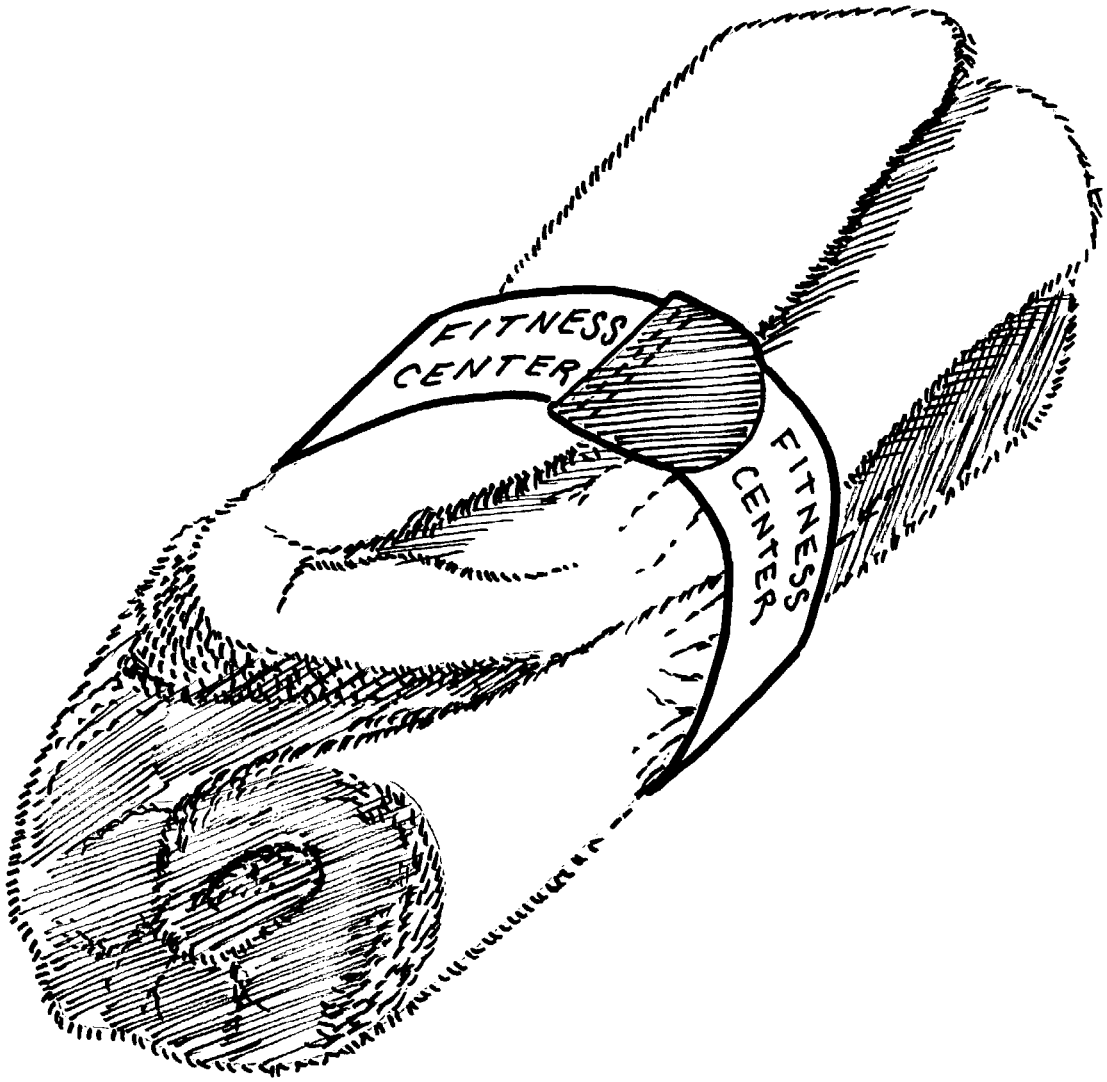

FIG. 9 Shows fitness center application/utility of WRAP-IT! where product is used to secure a towel wrap, again with logo capability.

Drawing 6

Figure 10:
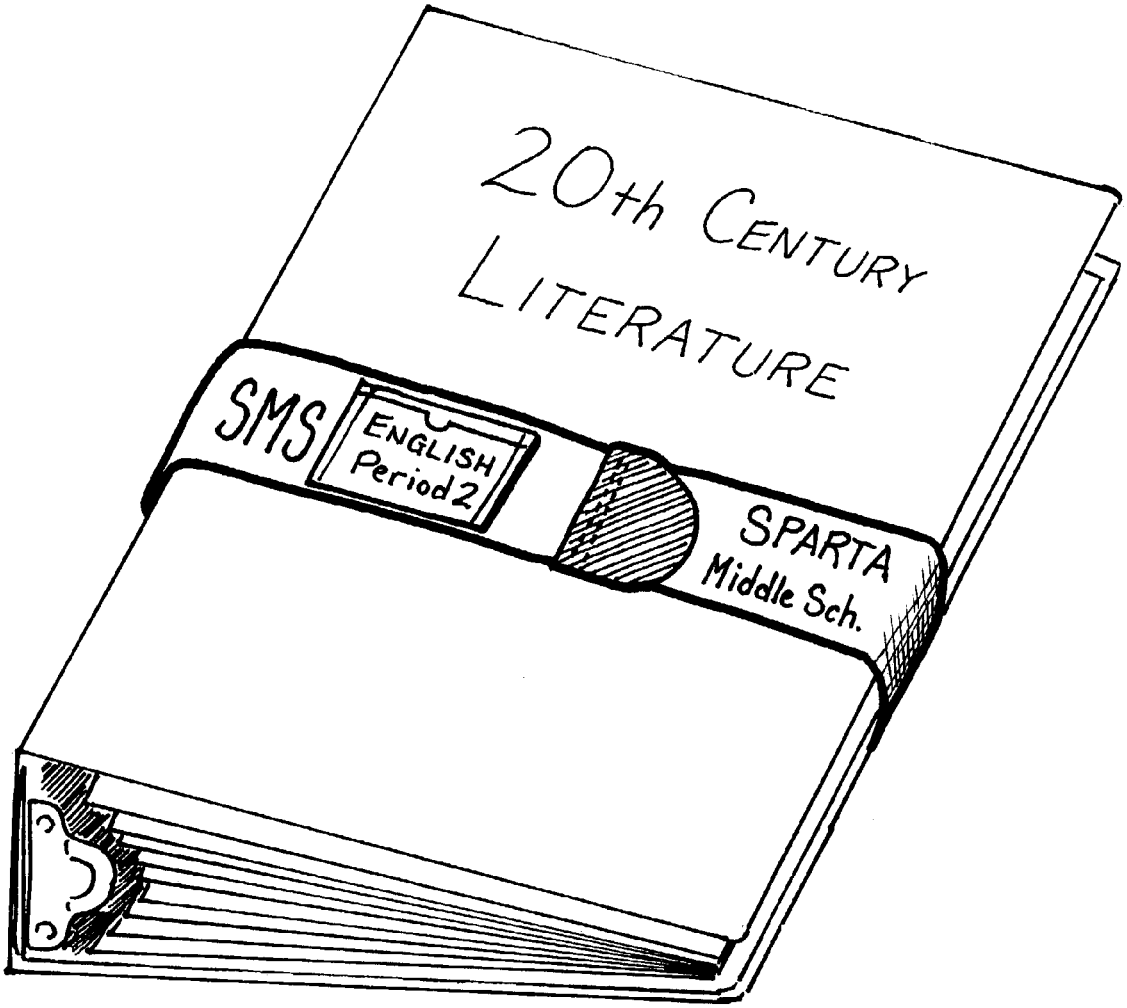

FIG. 10 Shows school applications for both students and teachers where WRAP-IT! is used to secure and organize files for student projects and courses as well as teachers' use for transferring and organizing student files and course materials.

DETAILED DESCRIPTION OF THE INVENTION

WRAP IT! will be manufactured in different sizes to address different market segments and anticipated user preferences. The dimensions provided in this detailed description are for illustrative purposes only. The concept and utility of the product is identical regardless of the dimensions.

There are five basic component parts to WRAP-IT! The first component is an expandable loop fabric strap, 22 inches long by 2 inches wide (FIG. 2). The second component is a 2.25-inch, by 2-inch piece of faced down hook fabric (FIG. 3). The third component is a 2.25-inch, by 2-inch piece of vinyl fabric (FIG. 4)(may be substituted with leather). The fourth component is a 3 inch by 2.5 inch, (business card size) plastic sleeve (FIG. 5), with a transparent front. The fifth component is a 3 inch wide by 2.5 inch long piece of faced down hook fabric (FIG. 6).

Figure 1:
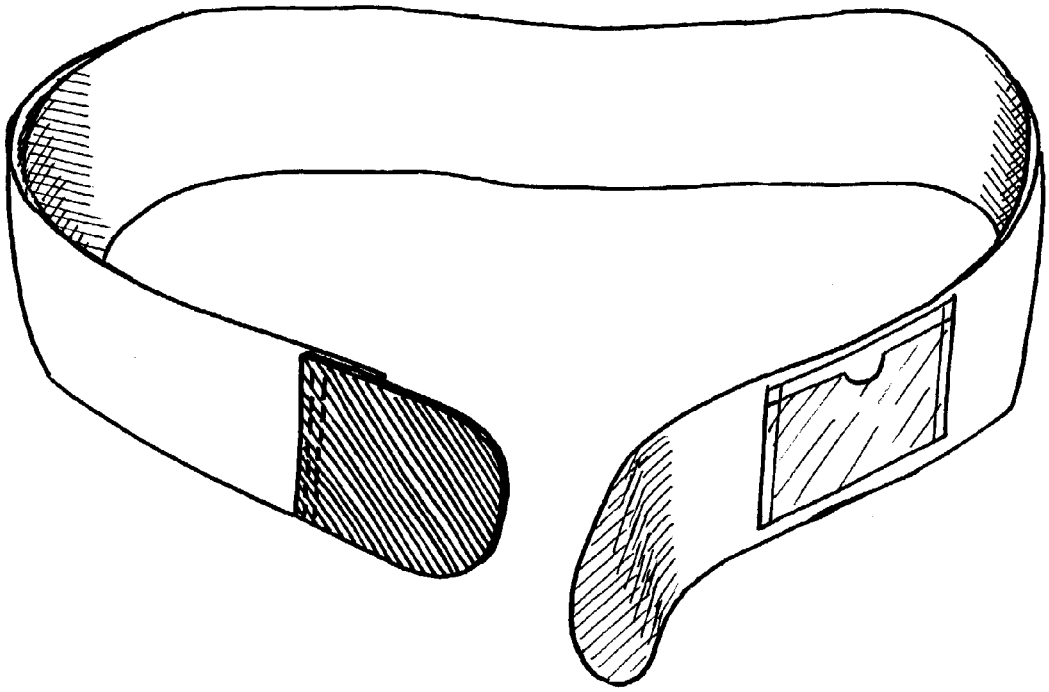
FIG. 1 Shows the configured product.

WRAP IT! is manufactured by bonding the back of the vinyl fabric (FIG. 4), to the back of the hook material (FIG. 3) with an aerosol adhesive. The combined components, (FIG. 3 & FIG. 4) is then attached to the expandable loop fabric strap using reinforced stitching as shown in Drawing 2. The components are stitched with a 0.25-inch overlap with the vinyl backed hook fabric facing down to face the loop side of the expandable loop fabric. The back of the plastic sleeve is then bonded to the back of a 3.5-inch by 2-inch hook fabric with an aerosol adhesive. The configured product is illustrated in Drawing 1 (FIG. 1).

The purpose of the sleeve is to label the intended contents of what WRAP-IT! is to be wrapped around—(i.e. "English Period 2"—FIG. 10). or simply to insert a business card. This sleeve can be affixed to the strap material anywhere along the loop fabric.

This product replaces and dramatically improves upon many other organizational tools. WRAP-IT! is more reliable than a rubber band and offers flexibility to adjust the fit and snugness to the size of the objects, (FIG. 7, FIG. 8, FIG. 9, FIG. 10). WRAP-IT! is more secure than a file folder which is especially important when transferring files out of the office. WRAP-IT! is more flexible than 3 ring binders as there is no need to put unwanted holes in documents and additions/deletions to the contents of WRAP-IT! are much easier to make. WRAP-IT! can be used in concert with brief cases and folders to enhance the ability to maintain documents, files, and other objects in an organized manner. The use of the labeling sleeve provides the ability to turn WRAP-IT! into a marketing tool as well as this product can be used to present sales literature, brochures and bid proposals (FIG. 7). This product, with the use of logos for corporate, team, college, school, firm or any other organization, provides a powerful branding and marketing tool along with the primary function as an organizational tool of preventing files from turning into piles.

The product is employed by wrapping expandable loop fabric strap around articles (files, documents, other) until there is a snug fit at which point the hook based end of the strap is affixed to the loop fabric. The plastic sleeve, backed with hook fabric, is affixed to the loop strap and either a label indicating the contents of the wrap or a business card is inserted in the sleeve.

The invention is an organizational device comprised of five component parts: 2 pieces of hook fabric, 1 piece of expandable loop fabric, 1 piece of vinyl fabric or leather fabric, and 1 plastic business card sized sleeve with a clear window front. The back of the hook fabric is glued or otherwise bonded to the back of the vinyl material. The end of the loop fabric is stitched or otherwise bonded to the vinyl backed hook fabric. The plastic sleeve is glued or otherwise bonded to the back of hook fabric of similar dimensions. The components are constructed and arranged to permit a continuous ability to adjust and secure the vinyl backed hook end member anywhere along the expanded loop fabric. The hook backed plastic sleeve can be affixed anywhere continuously along the expanded ioop fabric. The product to be used as an organization tool with professional, educational, and home use applications to secure files, documents and other articles, that is both flexible and effective. The product is employed by wrapping expandable loop fabric strap around articles (files, documents, other) until there is a snug fit at which point the hook based end of the strap is affixed to the loop fabric. The plastic sleeve, backed with hook fabric, is used to hold a business card or a label indicating the contents of the wrap. The product utility includes means of promoting organizational name/logo for corporation, firm, team, school or college. The organization name or logo is printed in a repeat fashion on the expandable loop fabric as well as on the vinyl (or leather) fastener cover.

What is claimed is:

1. A combination of an organizational device and at least one of files, binders, books or other documents, the device for wrapping about a plurality of stacked articles such as files, binders, books and other documents and comprising:

an elongate continuous elastic loop fabric strap having opposed ends;

a hook fastener at one said end of said strap, said hook fastener being releasably attachable to said strap at any location therealong whereby said flies, binders, books, or other documents are wrapped by said strap; and an informational card carrying sleeve having a transparent face, said sleeve having a hook fastener member attached thereto and being removably attachable to said elastic loop strap at any location therealong.

2. A device of claim 1 wherein the hook fastener is bonded to said one end of said strap.

3. A device of claim 2 wherein said hook fastener is attached to a backing.

4. A device of claim 3 wherein said hook fastener is bonded to said backing.

5. A device of claim 4 wherein said backing is selected from the group consisting of vinyl material and leather.

6. A device of claim 1 wherein said plastic sleeve is attached to a hook fastener member and said hook fastener member is attachable to said strap.

7. A device of claim 6 wherein said plastic sleeve is bonded to said hook fastener member.

8. A device of claim 1 wherein said strap includes additional informational material thereon.

9. A device of claim 1 wherein indicia is provided on at least one of the fabric strap and the informational card carrying sleeve.

* * * * *